US005260507A

United States Patent [19]

Hagino et al.

[11] Patent Number: 5,260,507

[45] Date of Patent: Nov. 9, 1993

[54] ENVELOPE WAVEFORM GENERATION APPARATUS FOR AN ELECTRONIC MUSICAL INSTRUMENT RESPONSIVE TO TOUCH DATA

[75] Inventors: Kiyoshi Hagino; Kiyoshi Yoshida, both of Hamamatus, Japan

[73] Assignee: Yamaha Corportion, Hamamatsu, Japan

[21] Appl. No.: 673,763

[22] Filed: Mar. 20, 1991

[30] Foreign Application Priority Data

Mar. 20, 1990 [JP] Japan ..... 2-70266

[51] Int. Cl.[5] ..... G10H 1/057; G10H 1/06; G10H 1/18

[52] U.S. Cl. ..... 84/615; 84/622; 84/626; 84/627; 84/DIG. 7

[58] Field of Search ..... 84/615-620, 84/622-633, DIG. 7

[56] References Cited

U.S. PATENT DOCUMENTS 4,528,885 7/1985 Chihana ..... 84/626

5,140,886 8/1992 Masaki et al. ..... 84/627 X

FOREIGN PATENT DOCUMENTS 1-55469 11/1989 Japan .

*Primary Examiner*—Stanley J. Witkowski

*Attorney, Agent, or Firm*—Spensley Horn Jubas & Lubitz

[57] ABSTRACT

An envelope waveform generation apparatus which generates an envelope waveform consisting of a plurality of segments in order to control a musical tone signal, having a touch data detection device, which detects touch data corresponding to the relative strength of a generated musical tone, a memory device, which stores a plurality of control mode patterns comprising data showing whether each segment of this envelope waveform is to be controlled by means of this touch data, a selection device, which selects from among the plurality of control mode patterns stored in the memory device, and a touch data supplementing device, which controls each segment of the envelope waveform by means of the touch data, when the data in the control mode pattern selected by the selection device show the each segment is to be controlled.

11 Claims, 7 Drawing Sheets

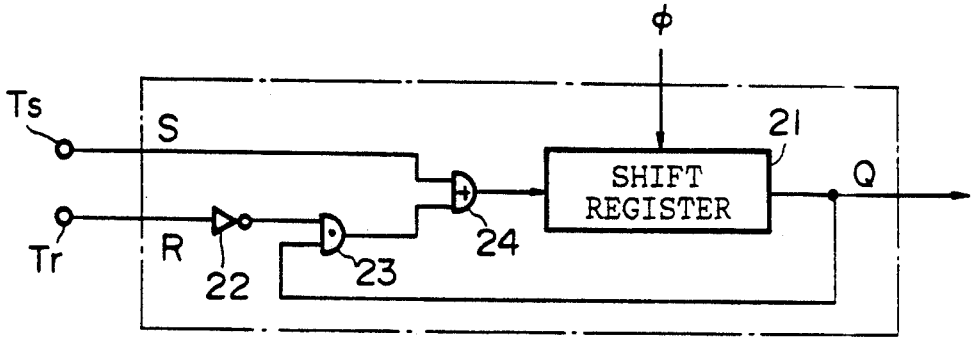
FIG.2
| SEGMENT / MODE | ATTACK | FIRST DECAY | SECOND DECAY | HOLD | RELEASE |
|---|---|---|---|---|---|
| FOR CONTINUING TONES | 1 | 0 | 0 | 0 | 1 |
| FOR DEMINISHWG TONES | 0 | 1 | 0 | 0 | 1 |
| FOR BASS TONES | 1 | 0 | 0 | 0 | 1 |
FIG.3
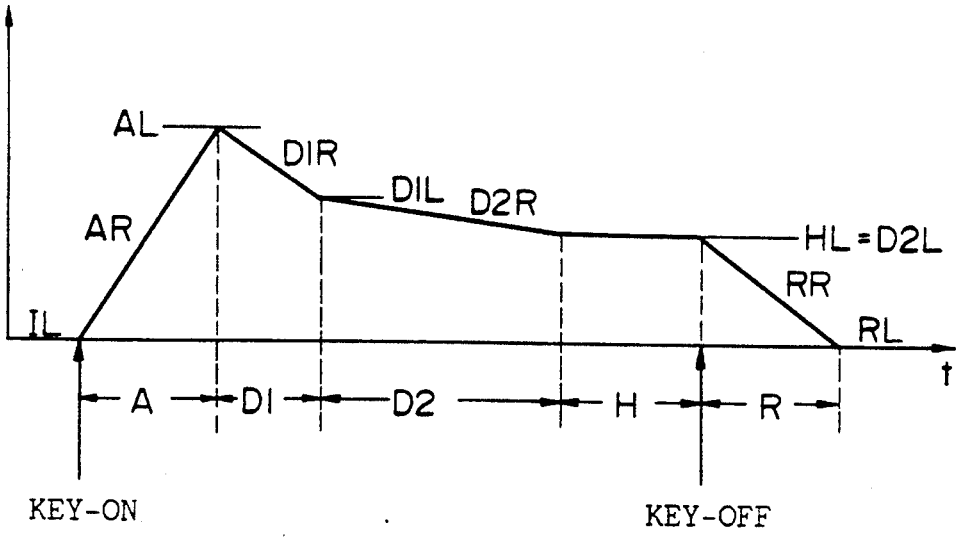
FIG.4

ENVELOPE WAVEFORM GENERATION APPARATUS FOR AN ELECTRONIC MUSICAL INSTRUMENT RESPONSIVE TO TOUCH DATA

BACKGROUND OF THE INVENTION

1. Field of the Invention

The present invention relates to an envelope waveform generation apparatus which is applicable to electronic musical instruments and generates an envelope waveform in order to control the tone volume amplitude of musical tones.

2. Background Art

FIG. 10 shows the composition of an electronic musical instrument to which a conventional envelope waveform generation circuit 4 has been applied. In the diagram, reference numeral 1 indicates a keyboard comprising a plurality of keys; when one of the plurality of keys with which this keyboard 1 is provided is operated by depression, this is detected by key depression detection circuit 2. Key depression detection circuit 2 outputs a key code KC which corresponds to the depressed key and outputs a key-on signal KON during the period in which the key is being depressed; key code KC is supplied to musical tone signal generation circuit 3, and furthermore, key-on signal KON is supplied to envelope waveform generation circuit 4. Reference numeral 5 indicates a tone color selection apparatus, which is for the purpose of the selecting a desired tone color from among a plurality of piano or organ tone colors or the like. This tone color selection apparatus outputs a tone code TC corresponding to the selected tone color to envelope waveform generation circuit 4 and musical tone signal generation circuit 3. Envelope waveform generation circuit 4 generates, in response to the arrival of key-on signal KON, an envelope waveform ENV corresponding to tone code TC, and supplies envelope waveform data ENVD corresponding to this envelope waveform ENV to musical tone signal generation circuit 3. Envelope waveform ENV comprises for example, as shown in FIG. 11, the four segments known as attack part A, decay part D, sustain part S and release part R. At the point in time at which a key is depressed and key-on signal KON is received, attack part A begins, then delay D and sustain S are proceeded to, and at the point at which the key is no longer pressed (key-off) and the reception of the key-on signal KON is halted, release part R begins. Musical tone signal generation circuit 3 generates, in accordance with the envelope waveform data ENVD supplied by envelope waveform generation circuit 4, a musical tone signal with a tone color corresponding to the tone code TC supplied by tone color selection apparatus 5 at a tone pitch corresponding to the key code KC supplied by key depression detection circuit 2. The musical tone signal outputted from this musical tone signal generation circuit 3 is converted to an analog signal by D/A converter 6, then supplied to a sound system 7 comprising amps, speakers and the like, and emitted from this sound system 7 as a musical tone.

In this type of electronic musical apparatus touch response control, initial touch control and after-touch control are known; however, in conventionally known technology, the degree of effect with respect to any musical tone which is key-touched is dependent solely on the strength of the key touch, and the changing of the state of effect of the key touch in each segment was unknown.

The applicants have previously submitted an electronic musical instrument (Japanese Patent Application, 2nd publication, No. Hei 1-55469) which is provided with an initial touch detection mechanism which detects the initial key touch of a depressed key and outputs an initial touch detection signal, and an after-touch detection mechanism which detects key touch while a key is being depressed and outputs an after-touch detection signal. In this electronic musical instrument, the initial touch detection signal and the after-touch detection signal are combined in such a way that the proportion of the initial touch detection signal is large in the initial part of the envelope waveform, and the proportion of the after-touch detection signal becomes large after passing the initial part. In accordance with this type of electronic musical instrument, the initial touch component has a stronger effect in attack part A, and the after-touch component has a stronger effect once attack part A has been passed.

In general, an infinite variety of patterns of effect of touch are possible with respect to each segment from generation to termination of a musical tone, and an ability to change in various ways in accordance with the wishes of a performer or in accordance with a selected tone color is required. However, in the conventional electronic musical instrument described above, the effect of touch is predetermined to be a fixed pattern, so that this fixed touch effect pattern may in some cases generate disharmonies in musical tones with certain tone colors, and the freedom of the performer with respect to the touch effects in each segment is limited.

SUMMARY OF THE INVENTION

The present invention was created in view of the above conditions; it provides an envelope waveform generation apparatus which enables the free selection of a touch effect pattern corresponding to each segment of an envelope waveform from among a plurality of such patterns.

The present invention provides an envelope waveform generation apparatus which generates an envelope waveform consisting of a plurality of segments in order to control a musical tone signal, and has a touch data detection means, which detects touch data corresponding to a musical tone to be generated, a memory means, which stores a plurality of control mode patterns comprising data showing whether each segment of the envelope waveform is to be controlled by means of the touch data, a selection means, which selects a control mode pattern from among the plurality of control mode patterns stored in the memory mechanism, and a touch data supplementing mechanism, which controls each segment of the envelope waveform by means of the touch data, when the data in the control mode pattern selected by the selection mechanism show the each segment is to be controlled.

In accordance with the composition of the present invention, a plurality of touch data supplementing mode patterns corresponding to each segment of an envelope waveform are stored in the memory mechanism, and each segment of the envelope waveform is supplemented by touch data in response to the supplementing mode pattern which is selected by means of the selection mechanism from among the plurality of supplementing mode patterns stored in the memory mechanism. Therefore, it is possible to freely select the touch effect of each segment of the envelope waveform.

BRIEF DESCRIPTION OF THE DRAWINGS

FIG. 2 is a block diagram showing the composition of the time-division flip-flops of FIGS. 1(A) and 1(B).

FIG. 3 shows the composition of the touch effective/ineffective table of FIGS. 1(A) and 1(B).

FIG. 4 is a waveform diagram showing an example of an envelope waveform ENV in accordance with a preferred embodiment of the present invention.

DETAILED DESCRIPTION OF THE PREFERRED EMBODIMENTS

Hereinbelow, a preferred embodiment of the present invention will be described with reference to the diagrams.

Figure 1A:
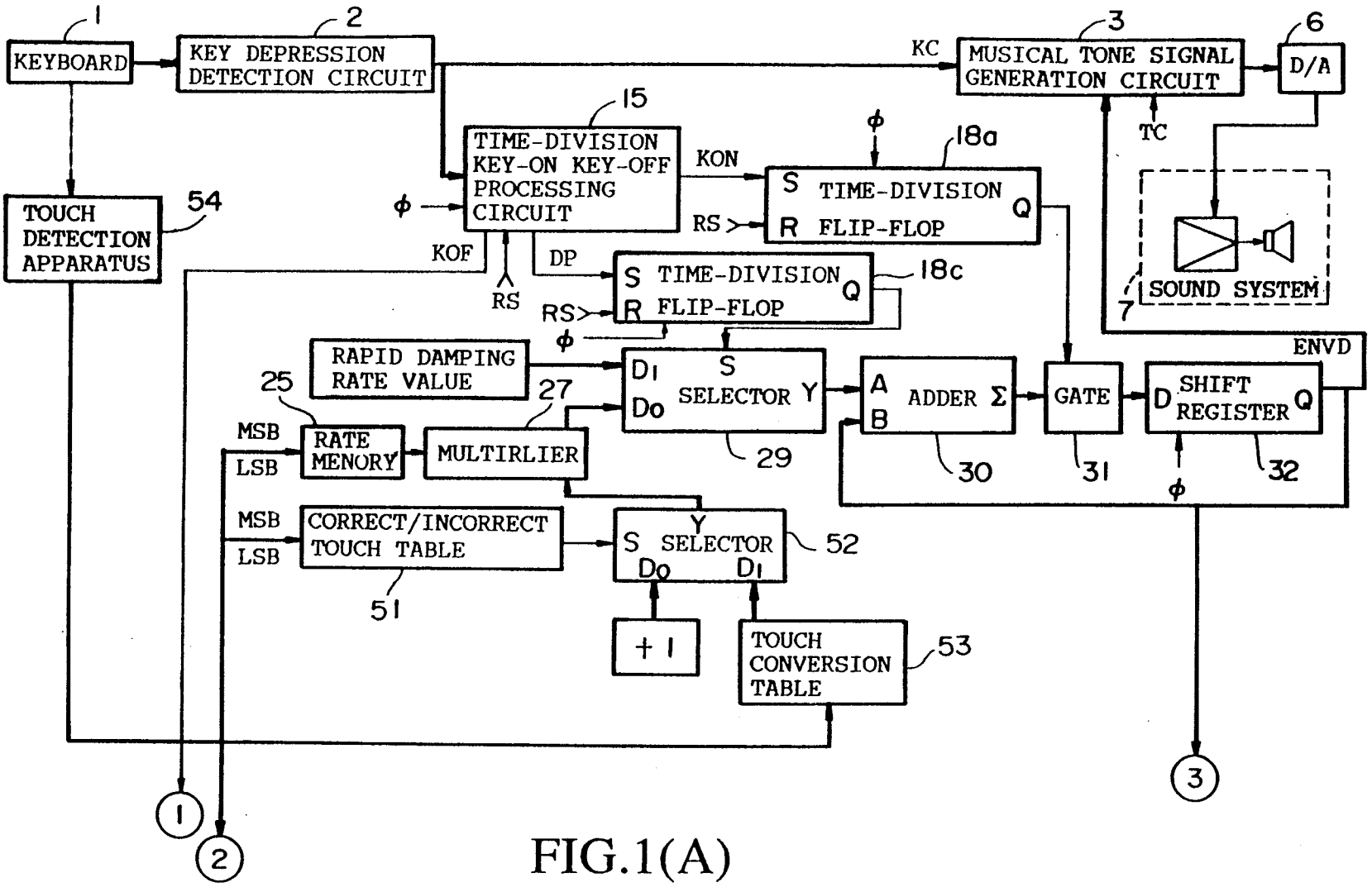
FIGS. 1(A) and 1(B) are block diagrams showing the composition of an electronic musical instrument to which an envelope waveform generation apparatus in accordance with a preferred embodiment of the present invention has been applied.
Figure 1B:
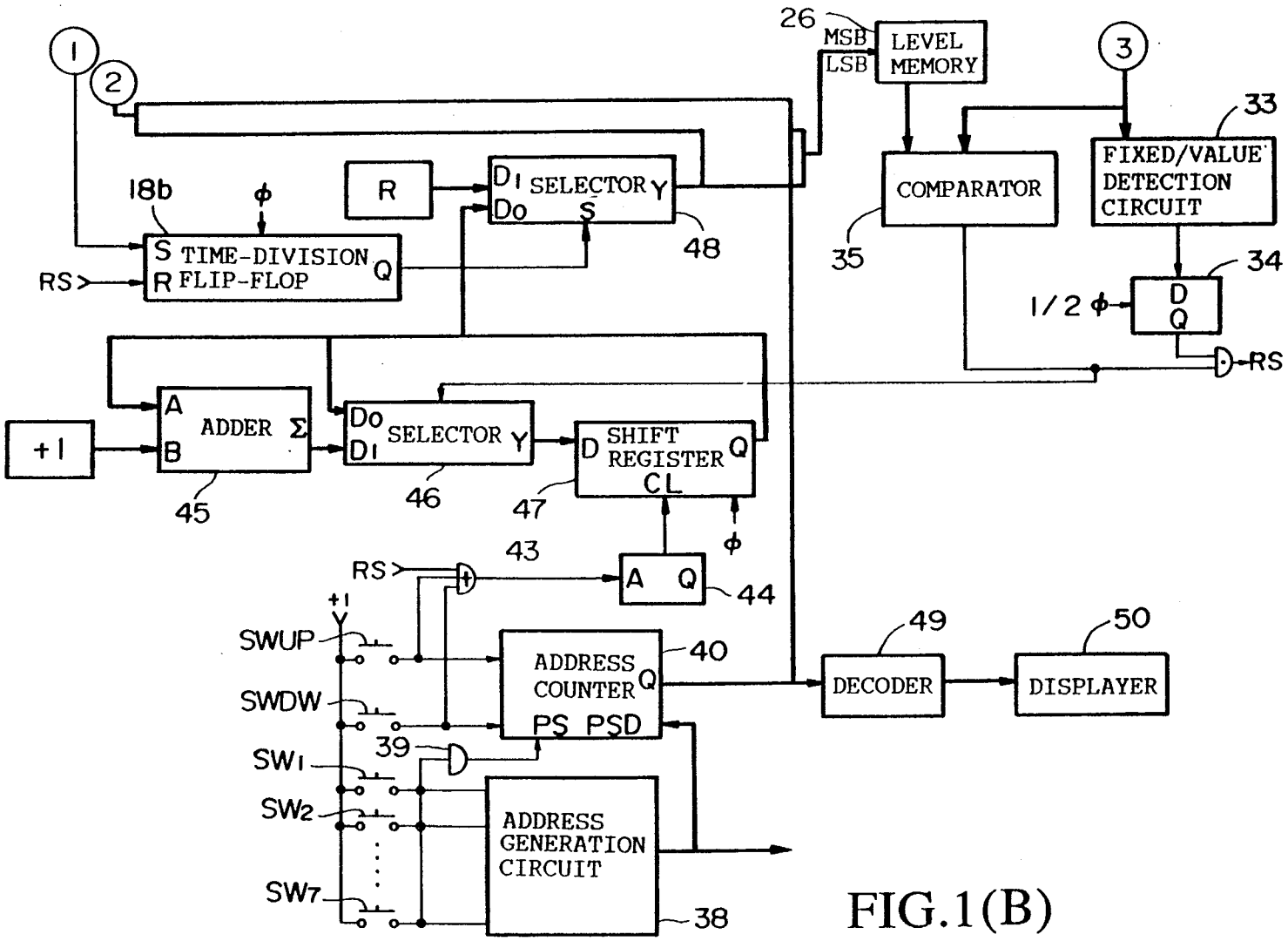
Figure 10:
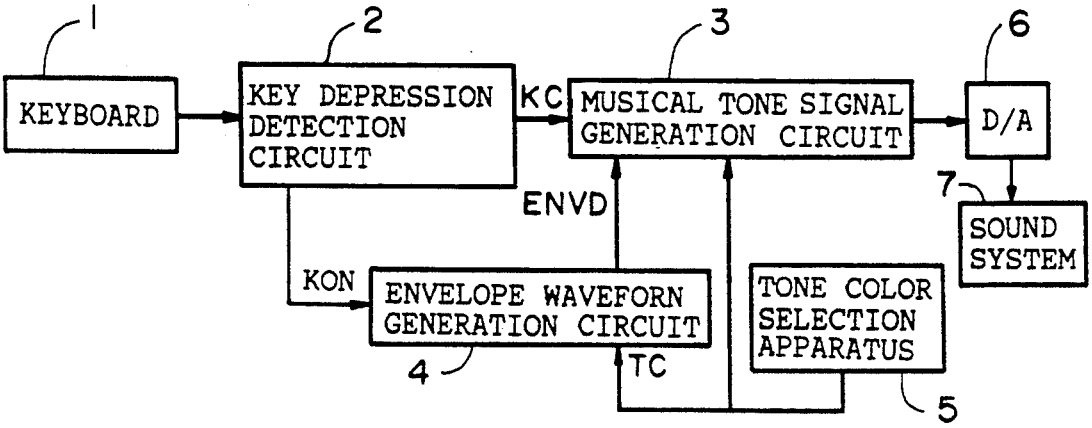
FIG.10 (PRIOR ART)
FIG. 10 is a block diagram showing an example of the composition of a conventional electronic musical instrument.
Figure 11:
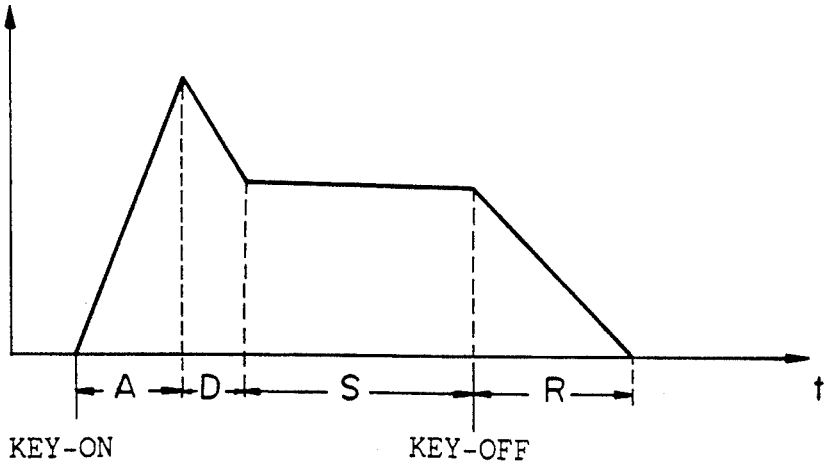
FIG.11 (PRIOR ART)
FIG. 11 is a waveform diagram showing an example of an envelope waveform ENV.

FIGS. 1(A) and 1(B) show the composition of an electronic musical instrument to which the envelope waveform generation apparatus of the present preferred embodiment has been applied. In the diagrams, the same reference numerals have been used for those parts corresponding to the parts of FIG. 10, and an explanation thereof is omitted here.

In FIGS. 1(A) and 1(B), reference numeral 15 indicates a time-division key-on-key-off processing circuit; it has a key assign which is able to allocate up to 8 tones to eight channels in reverse order based on the key code KC outputted by key depression detection circuit 2, and it outputs key-on signal KON and key-off signal KOF at time divisions with a different timing for each channel. Furthermore, in the case in which a key is pressed which is identical to a key which has been previously allocated to a certain channel in the course of the generation of these eight tones, the channel to which this key has been allocated is searched for and a rapid damping signal DP is outputted at the timing of that channel. After the conclusion of damping, a key-on signal KON is outputted again at the timing of that channel.

Reference numerals 18*a* to 18*c* indicate time-division flip-flops. Key-on signal KON, key-off signal KOF, and damping signal DP are inputted into these flip-flops respectively, and a "1" level signal is outputted to each channel at the timing of each channel until the input of a reset signal RS.

FIG. 2 shows the concrete construction of these time-division flip-flops. In the diagram, reference Ts indicates a set signal import terminal, which inputs a set signal such as key-on signal KON or the like. Reference Tr indicates a reset signal import terminal, which inputs a reset signal RS. Reference numeral 21 indicates a one-bit, eight-stage shift register, which shifts one bit of inputted data so that it is synchronous with clock phi. Reference numeral 22 indicates an inverter, which inverts reset signal RS. Reference numeral 23 indicates an and-gate, into the first input terminal of which is inputted the output of inverter 22, and into the second input terminal of which is inputted the output of shift register 21. Reference numeral 24 indicates an or-gate, into the first input terminal of which is inputted a set signal, and into the second input terminal of which is inputted the output of and-gate 23.

Returning to FIGS. 1(A) and 1(B), reference numerals 25 and 26 indicate a rate memory and a level memory respectively. Rate data and level data of envelope waveforms ENV which are previously determined for each musical tone of for example a piano, string instrument, brass instrument, trumpet, organ, pipe organ or the like are stored in rate memory 25 and level memory 26. That is, envelope waveforms ENV comprise the following five segments, as shown in FIG. 4: attack part A, first decay part D1, second decay part D2, hold part H, and release part R. The rate data, which show the slope of the waveform at each segment, and the level data, which show the target values of the waveform, are stored in rate memory 25 and level memory 26 for each tone color. In other words, an envelope waveform ENV begins at initial level IL, then this level changes with time at a fixed attack rate AR up to attack level AL, and by means of this the curve of attack part A is formed. From attack level AL up to first decay level D1L, the level changes with time at a fixed first decay rate D1R, and by means of this the curve of first decay part D1 is formed. Furthermore, the level changes with time at a fixed second decay rate D2R up to second decay level D2L (=hold level HL), and by means of this the curve of second delay part D2 is formed. After this, until the release of the key, hold level HL is maintained, and this is hold part H. Based on the release of the key, the level changes with time at a fixed release rate RR from hold level HL up to release level RL, and by means of this the curve of release part R is formed.

Reference numeral 27 indicates a multiplier which multiplies rate data outputted from rate memory 25 by data selected by selector 52, which is discussed hereinafter; multiplier 25 supplies the results of this multiplication to selector 29. Selector 29 selects and outputs data supplied from rate memory 25 through the medium of multiplier 27 when the output signal of time-division flip-flop 18*c* has a level of "0", and selects and outputs an rapid damping rate value when the output signal of time-division flip-flop 18*c* has a level of "1."

Furthermore, reference numeral 30 indicates an adder, reference numeral 31 indicates a gate, and reference numeral 32 indicates a shift register. The output data of selector 29 are inputted into the addition input terminal A of adder 30. The addition output of adder 30 is inputted into shift register 32 through gate 31, which is opened and closed by means of the output signal of time-division flip-flop 18*a*, and shifted so that it is synchronous with clock phi. After this, it is fed back to addition input terminal B of adder 30 and outputted as envelope waveform data ENVD which show the current waveform level of envelope waveform ENV.

Furthermore, reference numeral 33 indicates a fixed-value detection circuit, which detects the reaching of a fixed value (for example, nearly zero) by the output data of shift register 32 and outputs a detection signal. Reference numeral 34 indicates a D-type flip-flop (hereinafter referred to as D-flip-flop) which delays the detection signal by ½ of clock phi. Reference numeral 35 indicates a comparator, which compares the output data of shift register 32 and the output data level memory 26 and outputs an equality signal EQ in the case in which the two are identical. Reference numeral 36 indicates an and-gate, into the first input terminal of which the output data of D-flip-flop 34 are inputted, into the second input terminal of which equality signal EQ is inputted, and which outputs reset signal RS.

Furthermore, reference numeral 37 indicates a group of tone color selection switches comprising push switches $SW_1$ to $SW_7$. These are push switches for the selection of tone colors in which $SW_1$ is a piano, $SW_2$ is a stringed instrument, $SW_3$ is a brass instrument, $SW_4$ is a trumpet, $SW_5$ is an organ, $SW_6$ is a pipe organ, and $SW_7$ is for the selection of a musical tone previously set by a performer. Voltage from a power source is impressed upon one end of each of these push switches.

Reference numeral 38 indicates an address generation circuit, which generates addresses corresponding to push switches $SW_1$ to $SW_7$ by means of the pushing of one of the push switches $SW_1$ to $SW_7$ and outputs these addresses as tone code TC. Reference numeral 39 indicates a seven-input or-gate; one end of each of the push switches $SW_1$ to $SW_7$ is connected to the first to seventh input terminals respectively of this or-gate 39. Reference numeral 40 indicates an address counter, which synchronizes the address outputted by address generation circuit 38 with the output of or-gate 39 and loads it, and each time push switch SWUP or push switch SWDW is pushed, increases the value of this by one or decreases it by one. Voltage from a power source is impressed upon one end of each of these push switches SWUP and SWDW.

Furthermore, reference numeral 43 indicates an input or-gate, into the first input terminal of which is inputted reset signal RS, and to the second and third input terminals of which are connected one end of the push switches SWUP and SWDW respectively. Reference numeral 44 indicates a one-shot multivibrator (hereinafter referred to as OS), into which the output of or-gate 43 is inputted and which outputs a fixed-period "1" level signal.

In addition, reference numeral 45 indicates an adder, reference numeral 46 indicates a selector, and reference numeral 47 indicates a shift register. A value of "1" is inputted into the addition input terminal B of adder 45. The addition output of adder 45 is inputted into the data input terminal $D_1$ of selector 46; when equality signal EQ from comparator 35 has a value of "1", it is selected and outputted, being then inputted into shift register 47. In shift register 47, this input is shifted so as to be synchronous with clock phi, and then fed back to addition input terminal A of adder 45. Furthermore, selector 46 selects and outputs the output data of shift register 47 when equality signal EQ has a level of "0." In addition, shift register 47 is reset by means of the output signal of OS 44.

Reference numeral 48 indicate a selector which selects and outputs the output data of shift register 47 when the output signal of time-division flip-flop **18*b* has a level of "0," and selects and outputs the address lower position data in order to indicate release part R when the output signal of time-division flip-flop 18*b* has a level of "1." Then, the output data of selector 48 and the output data of address counter 40 are supplied to rate memory 25, level memory 26 and touch effective/ineffective table 51** as the lower position data and upper position data of the address respectively.

Correct/incorrect touch table 51, as shown in FIG. 3, is a table showing whether each of the attack, first delay, second delay, hold and release segments are to be supplemented by touch data or not. Three types of touch supplementing patterns corresponding to the three types of musical tone mode of continuing tone, diminishing tone, and bass tone are stored in advance herein. In this case, "1" indicates touch supplementation (the touch has effect), while "0" indicates that touch supplementation is not made (the touch does not have effect). The output of this touch effective/ineffective table 51 is supplied to the control input terminal of selector 52. Selector 52 supplies the data "1" which was supplied to the $D_0$ input terminal thereof to multiplier 27 in the case in which a "0" signal is supplied to the control input terminal (the case in which touch supplementation is not made), and supplies the data which were supplied to the $D_1$ input terminal thereof to multiplier 27 in the case in which a "1" signal is supplied to the control input terminal (the case in which touch supplementation is made). Touch data corresponding to the key touch from touch conversion table 53 are supplied to the $D_1$ input terminal of selector 52. Touch conversion table 53 obtains touch data corresponding to the true strength of key depression based on the touch detection signal supplied by the conventional touch detection apparatus 54 which is provided on keyboard 1.

Furthermore, reference numeral 49 indicates a decoder which decodes the output data of address register 40 (the address data corresponding to the selected tone color) into display data. Reference numeral 50 indicates a displayer which displays the display data.

Next, the operation of the preferred embodiment described above will be explained. When a performer presses for example push switch $SW_5$, a tone code TC corresponding to an organ is outputted from address generation circuit 38 and is supplied to musical tone signal generation circuit 3. In addition, this tone code TC is made synchronous with the output of or gate 39 and loaded in address counter 40. By means of this, the tone code TC loaded into address counter 40 is supplied to rate memory 25, touch effective/ineffective table 51, level memory 26 and decoder 49 as the address upper position data. Furthermore, in decoder 49, the output data of address counter 40 are decoded into display data, and in displayer 50, a display conveying that the selected tone color is that of an organ is shown.

Time-division flip-flops **18*a*–18*c* and shift register 47 are reset when the power source is switched on. Accordingly, the output signals of time-division flip-flops 18*a*–18*c* are all at a "0" level, and the output data of shift register 47** is "0."

By means of this, the data "0" inputted into the data input terminal $D_0$ are selected by selector 48 and supplied to rate memory 25, touch effective/ineffective table 51 and level memory 26. Accordingly, data corresponding to attack rate AR and attack level AL which are linked to attack part A of the envelope waveform ENV of the organ are outputted from rate memory 25 and level memory 26. Then, the rate data outputted from rate memory 25 are supplied to selector 29 through the medium of multiplier 27.

In the case in which the selected tone color is the continuing tone system or bass tone system of an organ, as shown in FIG. 4, a "1" data fixed for that attack part is outputted from touch effective/ineffective table 51. By means of this, selector 52 selects the touch data supplied from touch conversion table 53 and supplies them to multiplier 27. As a result, multiplier 27 multiplies the attack part rate data outputted from rate memory by these touch data, in other words supplementing touch, and then supplies this to selector 29. On the other hand, in the case in which the selected tone color is the diminishing tone system of a piano or the like, as shown in FIG. 4, a "0" data fixed for that attack part is outputted from touch effective/ineffective table 51. By means of this, selector 52 selects a "1" data and supplies this to multiplier 27. As a result, multiplier 27 multiplies the attack part rate data outputted from rate memory 25 by this "1", in other words not supplementing touch, and then supplies this to selector 29.

The data selected by this selector 29 are inputted into addition input terminal A of adder 30, and furthermore the level outputted from level memory 26 is inputted into comparison input terminal B of comparator 35, and key-on signal KON is placed in a standby state.

Next, if the performer operates the keys corresponding to, for example, the C tone and the E tone, by means of this, key codes KC corresponding to these keys are outputted by key depression detection circuit 2, and in addition, key-on signals KON are outputted in a time-divided fashion from time-division key-on key-off processing circuit 15 with timings allocated to channel 1 and channel 2.

By means of this, key-on signals KON are inputted into time-division flip-flop 18*a*, and a "1" level signal is outputted from time-division flip-flop 18*a* at the timings of channel 1 and channel 2. Accordingly, as gate 31 is opened according to the timing of the output signal of time-division flip-flop 18*a*, the addition output of adder 30 is inputted into shift register 32 through gate 31. After this has been shifted so as to be synchronous with clock phi, it is fed back to the addition terminal B of adder 30 and outputted as envelope waveform data ENVD which indicate the present waveform level of envelope waveform ENV.

Furthermore, envelope waveform data ENVD are inputted into comparison input terminal A of comparator 35 and compared with the output data of level memory 26, which are inputted into comparison terminal B, and envelope waveform data ENVD are also inputted into fixed-value detection circuit 33. This point is immediately after key-on, so that equality signal EQ is not outputted from comparator 35, and no detection signal is outputted from fixed-value detection circuit 33. Accordingly, the addition output of adder 30 is an addition output resulting from the repeated addition of the rate data to envelope waveform data ENVD, and this envelope waveform data ENVD increases according to the slope corresponding to the rate data supplied through the medium of selector 29. This is conducted in a time-divided fashion with respect to each channel; in the present case, with respect to channels 1 and 2.

When the value of envelope waveform ENV becomes equal to attack level AL outputted from level memory 26 (see FIG. 4), equality signal EQ is outputted from comparator 35 and inputted into selector 46. By means of this, in selector 46, the value of data input terminal $D_1$, that is, the output value of adder 45, in this case "1," is selected and outputted, being then inputted into shift register 47. This is conducted in a time-divided fashion with respect to each channel; in the present case, with respect to channels 1 and 2.

Accordingly, the output data of shift register 47, that is, the value "1," is selected in selector 48 and inputted into rate memory 25 and level 26. Then, the rate data and level data of the first delay part are outputted from rate memory 25 and level memory 26 respectively. Then, the same type of operations as in the case of the attack part above are repeated, and envelope waveform data ENVD are outputted from shift register 32. This is conducted in a time-divided fashion with respect to each channel; in the present case, with respect to channels 1 and 2.

The operations explained above are carried out in a time-divided fashion in each channel from the attack part to the release part. When the value of envelope waveform data ENVD reaches a fixed value (nearly zero), a detection signal is outputted from fixed-value detection circuit 33 and is delayed by ½ of clock phi in D-flip-flop 34.

Subsequently, when envelope waveform data ENVD equal release level RL, that is, the level "0," equality signal EQ is outputted by comparator 35, so that a reset signal RS is outputted by and-gate 36 and inputted into time-division flip-flops 18*a*–18*c* and and-gate 43. By means of this, time-division flip-flops 18*a*–18*c* are reset, and a fixed-period "H"-level signal is outputted by OS 44, so that shift register 47 is reset as well. Furthermore, reset signal RS is inputted into key-on key-off processing circuit 15, and this key-on key-off processing circuit 15 is also reset.

If the performer operate the key of keyboard 1 corresponding to, for example, the E tone before envelope waveform ENV has completely diminished, key-off signal KOF is outputted, allocated to channel 2, by time-division key-on key-off processing circuit 15. By means of this, key-off signal KOF is inputted into time-division flip-flop 18*b*, and a "1" level signal is outputted at the timing of channel 2 by time-division flip-flop 18*b*. Accordingly, in selector 48, the address lower position data corresponding to the release part are selected and inputted into rate memory 25, touch effective/ineffective table 51 and level memory 26. By means of this, data corresponding release rate RR and release level RL of the release part are outputted from rate memory 25 and level memory 26 respectively. Subsequently, after these rate data have passed through multiplier 27 and selector 29, they are inputted into addition input terminal A of adder 30, and the level data are inputted into comparison input terminal B of comparator 35.

Accordingly, in this case, envelope waveform ENV diminishes with a steeper curve than natural diminishment.

Furthermore, operations described above are conducted with eight-tone independent time division; however, in the case in which the performer presses a key which is identical to a key which was previously allocated to a certain channel by key-on key-off processing circuit 15 while all eight tones are being generated, key-on key-off processing circuit 15 searches for the channel to which that key has been allocated and outputs an rapid damping signal DP at the timing of that channel.

By means of this, damping signal DP is inputted into time-division flip-flop 18*c* and a "1" level signal is outputted at the timing of that channel from time-division flip-flop 18*c*. Accordingly, in selector 29, the rapid damping value is selected and inputted into addition input terminal A of adder 30.

Accordingly, in this case, envelope waveform ENV is rapidly diminished.

Key-on key-off processing circuit 15 outputs key-on signal KON again at the timing of the channel after the passage of a fixed period; by means of this, the same tone is again generated.

In the following, other preferred embodiments will be explained.

Figure 5:
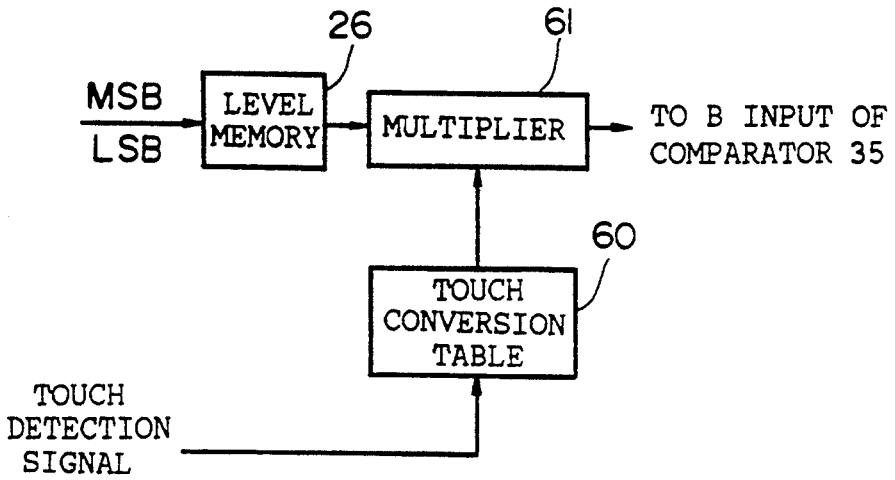
FIGS. 5-7 are block diagrams showing the composition of other preferred embodiments of the present invention.

FIG. 5 shows a preferred embodiment in which touch data supplement level data outputted from level memory 26. In this case, a touch conversion table 60, which obtains touch data for use in level control based on the touch detection signal supplied by the touch detection apparatus shown in FIGS. 1(A) and 1(B) and a multiplier 61, which multiplies the level data outputted from level memory 26 by the touch data and supplies the result to the B input terminal of comparator 35.

Figure 6:
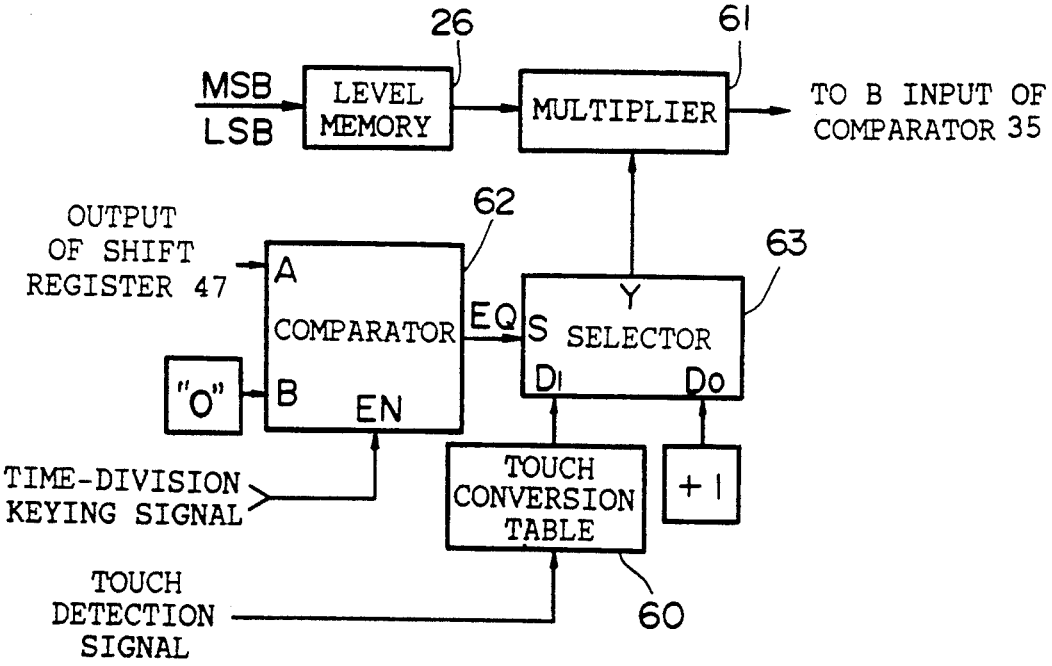

FIG. 6 shows a preferred embodiment in which touch data supplement level data in the attack part alone. In this case, a comparator 62, which compares the output of shift register 47 and "0" based on a time-division keying signal supplied by the time-division flip-flop 18*a* shown in FIGS. 1(A) and 1(B), and a selector 63, which normally supplies data "1" inputted into input terminal $D_0$ to multiplier 61 and selects touch data inputted into input terminal $D_1$ and outputs them to multiplier 61 in the case in which an equality signal is supplied by comparator 62, are provided. By means of this, in the case in which the output of shift register 47 is equal to "0," in other words, only in the case in which the attack part has been reached, an equality signal is outputted by comparator 62, and the touch data outputted by touch conversion table 60 are supplied to multiplier 61 through the medium of selector 63.

Figure 7:
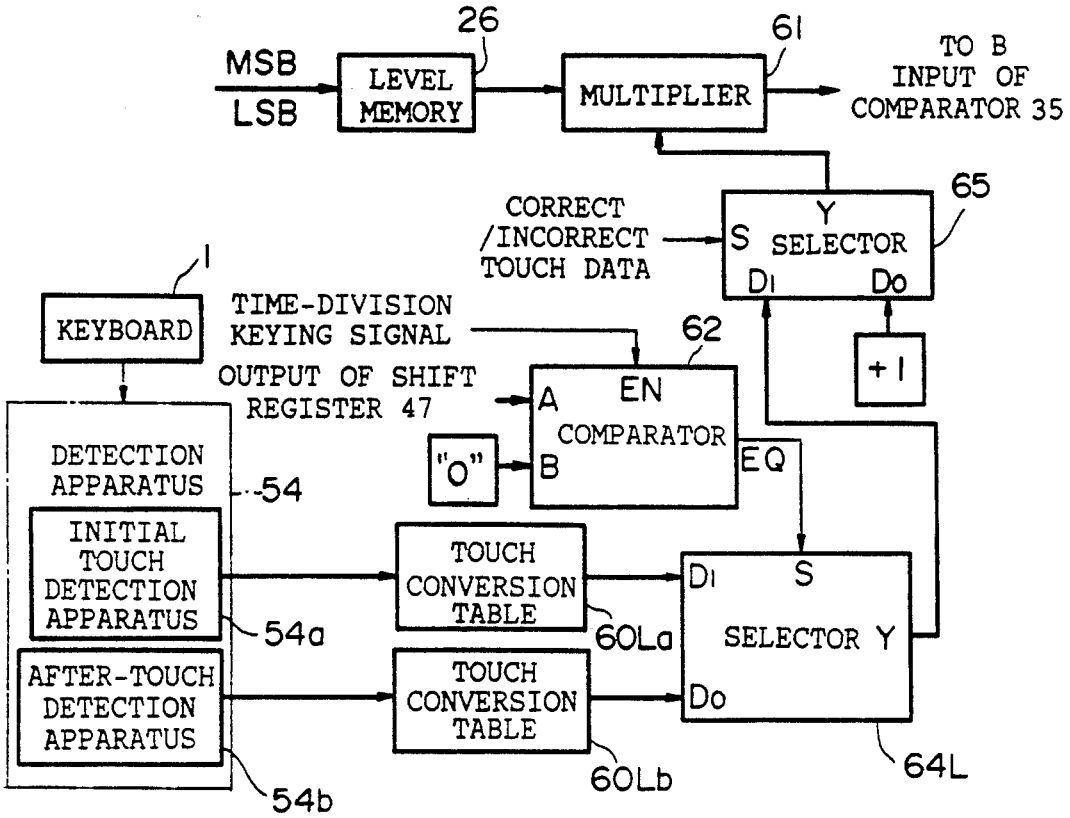
Figure 8:
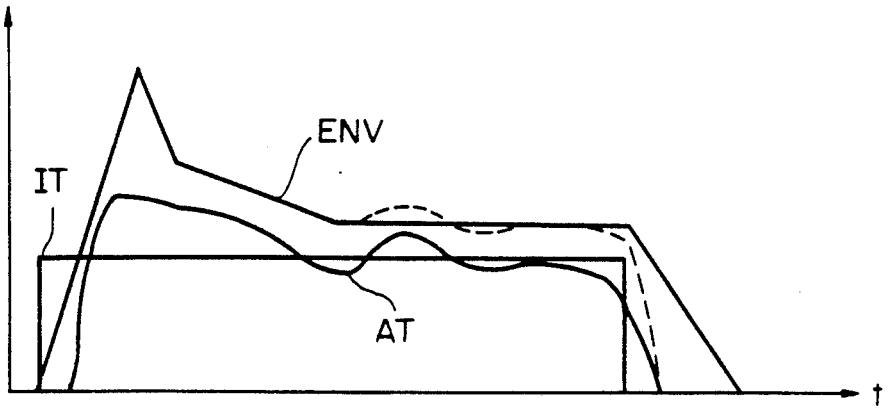
FIG. 8 is a waveform diagram showing an example of an envelope waveform ENV in accordance with the preferred embodiment of FIG. 7.

FIG. 7 shows a preferred embodiment in which initial touch data supplement the level data in the attack part, while in other parts, after-touch data supplement the level data. In this case, touch detection apparatus 54 comprises an initial touch detection apparatus 54*a*, which detects the initial key-touch of a key and outputs an initial touch detection signal, and after-touch detection apparatus 54*b*, which detects key-touch while a key is being pressed and outputs an after-touch detection signal. The initial touch detection signal is supplied to the $D_1$ input terminal of level selector 64L after being converted into initial touch data by level touch conversion table 60La. The after-touch detection signal is supplied to the $D_0$ input terminal of level selector 64L after being converted into after-touch data by level touch conversion table 60Lb. Selector 64L selects initial touch data in the case in which an equality signal is supplied by comparator 62 in the same way as in FIG. 6, and selects after-touch data in other cases, and supplies the selected data to selector 65. A signal indicating whether touch supplementation is made or not is supplied to selector 65 by touch effective/ineffective table 51 as shown in FIGS. 1(A) and 1(B), and in the case in which touch supplementation is made, the initial touch data or after-touch data supplied by selector 64 are outputted to multiplier 61, while in the case in which touch supplementation is not to be made, a data "1" is supplied to multiplier 61. By means of this, as shown in FIG. 8, for example, by means of initial touch IT and after-touch AT, the level of envelope waveform ENV is controlled. In addition, in the case in which the latter half of envelope waveform ENV is controlled by after-touch data AT, the change is shown by the dotted line in the diagram.

Figure 9:
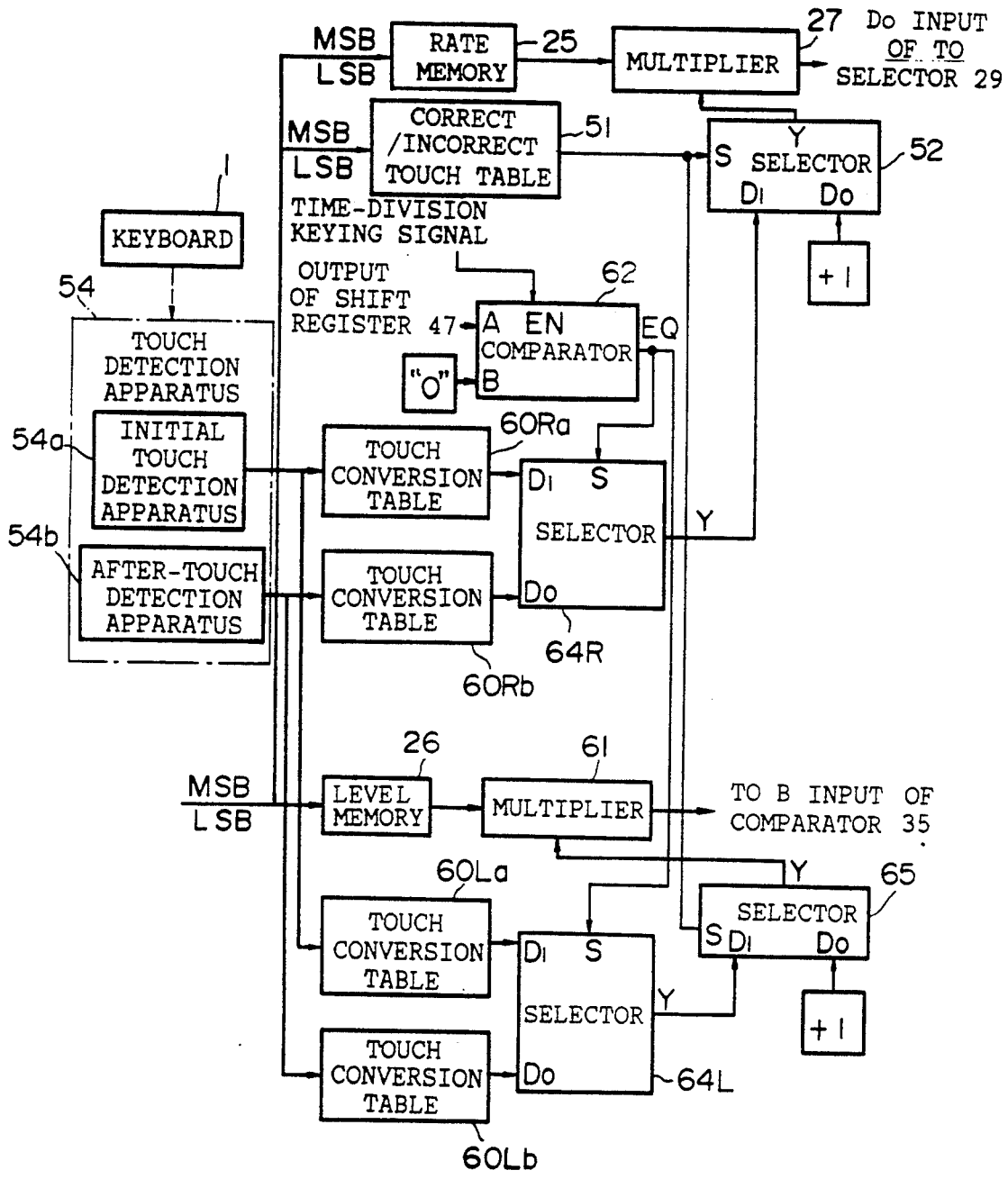
FIG. 9 is a block diagram showing the composition of another preferred embodiment of the present invention.

FIG. 9 shows a preferred embodiment in which initial touch data supplement rate data and level data in the attack part, while after-touch data supplement rate data and level data in other parts. In this case, in addition to the composition shown in FIG. 7, a rate touch conversion table 60Ra, which converts the initial touch detection signal outputted by initial touch detection apparatus 54*a* to initial touch data, a rate touch conversion table 60Rb, which converts the after-touch detection signal outputted by after-touch detection apparatus 54*b* to after-touch data, and a rate selector 64R, which selects these data and outputs them to selector 52, are provided.

In each preferred embodiment described above, touch supplementation is made by simply multiplying the touch data by the rate data or level data of each segment of an envelope waveform ENV; however it is also possible, for example, to multiply by 100% of the touch data in the attack part, by 60% of the touch data in the first and second delay parts, by 20% of the touch data in the hold part, and by 10% of the touch data in the release part. Furthermore, each musical tone mode (continuing mode, diminishing mode, bass mode) of touch effective/ineffective table 51 is selected by means of the switches of tone color selection switch group 37 and push switches SWUP and SWDW; however, it is of course also possible to select each musical tone mode by means of the output of a group of musical tone style selection switches which allow for the selection of combinations of musical tone rhythm, bass tone, tone color, and the like.

In addition, in each preferred embodiment described above, as examples were shown in which adder 30 was used in order to determine envelope waveform ENV, envelope waveform ENV changed in a geometric fashion; however, it is possible to use a multiplier in place of adder 30. In this case, envelope waveform ENV would change exponentially. Furthermore, in each preferred embodiment described above, examples were shown of performance-type envelope waveform generation apparatuses; however, it is of course possible to apply the invention to memory-type envelope waveform generation apparatuses as well.

As stated above, in accordance with the composition of the present invention, a plurality of touch data supplementing mode patterns corresponding to each segment of an envelope waveform are stored in the memory mechanism, and touch data supplement each segment of the envelope waveform in response to the supplementing mode pattern which is selected by means of the selection mechanism from among the plurality of supplementing mode patterns stored in the memory mechanism. Therefore, it is possible to freely select the touch effect of each segment of the envelope waveform, and by means of this, it is possible to utilize touch effects which match a variety of musical tones, to increase the freedom of playing, and to provide for an increase in the ability to produce musical tones.

What is claimed is:

1. An envelope waveform generation apparatus which generates an envelope waveform consisting of a plurality of segments in order to control a musical tone signal, comprising:

a touch data detection means for detecting touch data corresponding to a musical tone to be generated, a memory means for storing a plurality of control mode patterns each of which has data showing whether each segment of said envelope waveform is to be controlled by means of said touch data, a selection means for selecting a control mode pattern from among said plurality of control mode patterns stored in said memory means, and a touch data controlling means for controlling each segment of said envelope waveform based on said touch data in accordance with said data of said control mode pattern selected by the selection means.

2. An envelope waveform generation apparatus in accordance with claim 1, wherein said selection means is provided with a tone color selection function and selects tone color as well as said control mode pattern.

3. An envelope waveform generation apparatus in accordance with claim 1, wherein said touch data supplementing means controls a rate of each segment by means of said touch data.

4. An envelope waveform generation apparatus in accordance with claim 1, wherein said touch data supplementing means controls a level of each segment border by means of said touch data.

5. An envelope waveform generation apparatus in accordance with claim 1, wherein said touch data supplementing means permits to control only predetermined segments by means of said touch data.

6. An envelope waveform generation apparatus in accordance with claim 5, wherein said predetermined segment is an attack part, and said touch data supplementing means controls a level of said attack part by means of said touch data.

7. An envelope waveform generation apparatus in accordance with claim 1, wherein said touch data detection means detects both initial touch and after-touch, and said touch data supplementing means controls a level of a certain segment by means of initial touch data, and controls levels of other segments by means of after-touch data.

8. An envelope waveform generation apparatus in accordance with claim 7, wherein said certain segment is attack part in the envelope.

9. An envelope waveform generation apparatus in accordance with claim 1, wherein said touch data detection means detects both initial touch data and after-touch data, and said touch data supplementing means controls levels of first-half segments by means of the initial touch data, and controls levels of second-half segments by means of the after-touch data.

10. An envelope waveform generation apparatus in accordance with claim 1, wherein said touch data supplementing means changes a proportion of touch data control of each segment.

11. A method of generating an envelope waveform comprising the steps of:

detecting touch data corresponding to a musical tone to be generated;

storing a plurality of control mode patterns, each of which has data showing whether each segment of said envelope waveform is to be controlled by means of said touch data;

selecting a control mode pattern from among said plurality of control mode patterns stored in said memory means; and controlling each segment of said envelope waveform based on said touch data in accordance with said data of said control mode pattern selected by the selection means.

* * * * *